US008101327B2

(12) United States Patent
Tong et al.

(10) Patent No.: US 8,101,327 B2
(45) Date of Patent: Jan. 24, 2012

(54) OVERCOAT FOR ELECTROPHOTOGRAPHIC IMAGING MEMBER AND METHODS OF MAKING AND USING SAME

(75) Inventors: Yuhua Tong, Webster, NY (US); Cindy C. Chen, Hsinchu (TW); Susan M. VanDusen, Williamson, NY (US)

(73) Assignee: Xerox Corporation, Norwalk, CT (US)

( * ) Notice: Subject to any disclaimer, the term of this patent is extended or adjusted under 35 U.S.C. 154(b) by 1462 days.

(21) Appl. No.: 11/513,540

(22) Filed: Aug. 31, 2006

(65) Prior Publication Data

US 2008/0057424 A1 Mar. 6, 2008

(51) Int. Cl.
*G03G 5/05* (2006.01)
*G03G 5/047* (2006.01)

(52) U.S. Cl. ..... 430/58.7; 430/66; 430/96; 430/135; 430/133; 430/59.6

(58) Field of Classification Search ..... 430/58.7, 430/59.6, 96, 133, 66, 135
See application file for complete search history.

(56) References Cited

U.S. PATENT DOCUMENTS

| | | | | |
|---|---|---|---|---|
| 3,121,006 | A | 2/1964 | Middleton et al. | |
| 4,050,935 | A | 9/1977 | Limburg et al. | |
| 4,181,526 | A | 1/1980 | Blakey et al. | |
| 4,202,950 | A | 5/1980 | Statton | 525/123 |
| 4,265,990 | A | 5/1981 | Stolka et al. | |
| 4,281,054 | A | 7/1981 | Horgan et al. | |
| 4,286,033 | A | 8/1981 | Meyhart et al. | |
| 4,291,110 | A | 9/1981 | Lee | |
| 4,297,425 | A | 10/1981 | Pai et al. | |
| 4,298,697 | A | 11/1981 | Baczek et al. | |
| 4,338,387 | A | 7/1982 | Hewitt | |
| 4,338,390 | A | 7/1982 | Lu | |
| 4,355,154 | A | 10/1982 | Saam et al. | |
| 4,457,994 | A | 7/1984 | Pai et al. | |
| 4,560,635 | A | 12/1985 | Hoffend et al. | |
| 4,599,286 | A | 7/1986 | Limburg et al. | |
| 4,654,284 | A | 3/1987 | Yu et al. | |
| 4,871,634 | A | 10/1989 | Limburg et al. | 430/54 |
| 5,011,939 | A | 4/1991 | Limburg et al. | 548/440 |
| 5,147,751 | A | 9/1992 | Kojima et al. | |
| 5,264,312 | A | 11/1993 | Stolka et al. | 430/130 |
| 5,368,967 | A | 11/1994 | Schank et al. | 430/59 |
| 5,418,107 | A | 5/1995 | Nealey et al. | |
| 5,436,099 | A | 7/1995 | Schank et al. | 430/59 |
| 5,456,989 | A | 10/1995 | Nogami et al. | |
| 5,681,679 | A | 10/1997 | Schank et al. | |
| 5,702,854 | A | 12/1997 | Schank et al. | 430/59 |
| 5,709,974 | A | 1/1998 | Yuh et al. | 430/59 |
| 5,976,744 | A | 11/1999 | Fuller et al. | |
| 6,004,709 | A | 12/1999 | Renfer et al. | 430/58.65 |
| 6,071,659 | A | 6/2000 | Renfer et al. | 430/59.6 |
| 6,103,436 | A | 8/2000 | Yanus et al. | |
| 6,197,464 | B1 | 3/2001 | Dinh et al. | 430/58.75 |
| 6,207,334 | B1 | 3/2001 | Dinh et al. | 430/58.8 |
| 6,379,853 | B1 | 4/2002 | Lin et al. | 430/58.45 |
| 6,835,515 | B2 | 12/2004 | Tong et al. | 430/66 |
| 6,991,880 | B2 | 1/2006 | Tong et al. | 430/58.15 |
| 7,022,445 | B2 | 4/2006 | Tong et al. | 430/59.6 |
| 7,026,083 | B2 | 4/2006 | Fuller et al. | 430/66 |
| 7,056,632 | B2 | 6/2006 | Ioannidis | 430/56 |
| 2001/0044060 | A1 | 11/2001 | Shida et al. | |
| 2002/0119382 | A1 | 8/2002 | Nakata et al. | |
| 2003/0082468 | A1 | 5/2003 | Hu et al. | |
| 2004/0009419 | A1 | 1/2004 | Yokota et al. | 430/59.6 |
| 2004/0063013 | A1 | 4/2004 | Hongo et al. | |
| 2004/0101774 | A1 | 5/2004 | Yoshimura et al. | |
| 2005/0064337 | A1 | 3/2005 | Suganuma et al. | |
| 2005/0137301 | A1 | 6/2005 | Wu et al. | 524/196 |
| 2005/0266325 | A1 | 12/2005 | Yanagawa et al. | |
| 2006/0068309 | A1 | 3/2006 | Tong et al. | 430/74 |
| 2006/0110669 | A1 | 5/2006 | Maty et al. | 430/59.6 |
| 2007/0048636 | A1 * | 3/2007 | Qi et al. | 430/58.75 |
| 2007/0072101 | A1 | 3/2007 | Dinh et al. | |
| 2007/0134573 | A1 | 6/2007 | Yanus et al. | |
| 2007/0166634 | A1 * | 7/2007 | Qi et al. | 430/58.7 |

FOREIGN PATENT DOCUMENTS

| | | |
|---|---|---|
| EP | 0 660 191 | 6/1995 |
| EP | 1 014 205 | 6/2000 |
| EP | 1 174 771 | 1/2002 |
| JP | 2002341573 A * | 11/2002 |
| JP | 2002341574 A * | 11/2002 |

OTHER PUBLICATIONS

English language machine translation of JP 2002-341573 (Nov. 2002).*
English language machine translation of JP 2002-341574 (Nov. 2002).*
Technical Bulletin: Dura-New V-5 UV-curable Hardcoating . . . , California Hardcoating Co. website.
MSDS for Dura-New V-5, California Hardcoating Co. website.

* cited by examiner

*Primary Examiner* — Christopher Rodee
(74) *Attorney, Agent, or Firm* — Alix, Yale & Ristas, LLP

(57) ABSTRACT

Disclosed herein is an electrophotographic imaging member comprising a substrate, a charge transport layer and an overcoat layer formed by combining a film forming binder and a hole transporting hydroxy triarylamine compound having at least one hydroxyl functional group that is linked to a ring carbon of an aryl group by an alkyl group having 1 to 12 carbon atoms and is capable of forming at least one of a chemical bond and a physical bond with the film forming binder. Also disclosed is an electrophotographic imaging member with an overcoat layer formed by combining a film forming polycarbonate binder, a hole transport material, a surface energy reducing silicone material comprising a crosslinkable acrylate monomer, and a solvent. Coatings and methods of forming imaging members also are disclosed.

12 Claims, 1 Drawing Sheet

OVERCOAT FOR ELECTROPHOTOGRAPHIC IMAGING MEMBER AND METHODS OF MAKING AND USING SAME

BACKGROUND

The embodiments disclosed herein relate generally to electrophotographic imaging members and more specifically to overcoats for electrophotographic imaging members.

Electrophotographic imaging members are photoreceptors that typically include a photoconductive layer formed on an electrically conductive substrate. The photoconductive layer is an insulator in the dark so that electric charges can be retained on its surface. Upon exposure to light, the charge is dissipated.

One type of electrophotographic imaging member is a multi-layered device that comprises a conductive layer, an optional blocking layer, an optional adhesive layer, a charge generating layer, and a charge transport layer. The charge generating layer and charge transport layer can be combined into a single layer. One approach to achieving longer photoreceptor life is to form a protective overcoat on the imaging member. This overcoat layer usually is designed to resist image deletion and wear, while keeping transporting charges. Furthermore, application of this overcoat should not damage underlying layers of the photoreceptor. Additionally, the pot life of the coating solutions must be sufficiently long that the coating can be applied economically.

Known overcoats for imaging members are formed from hydrolyzed silica gel, crosslinked silicone or polyamides. Typical coatings are thin, usually less than 5 microns, in order to provide some degree of improvement in mechanical properties without substantially reducing the electrical properties of the charge transport layer.

Commonly assigned U.S. Pat. No. 6,835,515, the contents of which are incorporated herein by reference, describes a long potlife, low temperature cure overcoat for low surface energy electrophotographic imaging members. The overcoat is formed from a composition that includes a hole transport material such as a polyhydroxytriaryl amine, a cross-linkable film forming binder having at least one functional group that is reactive with isocyanate, a blocked isocyanate cross-linking agent, and a solvent having a boiling point equal to or below the deblocking temperature. The blocked isocyanate usually is the reaction product of an isocyanate and a blocking agent.

Commonly assigned U.S. Pat. No. 5,436,099 discloses an electrophotographic imaging member including a substrate, a charge generating layer, a charge transport layer, and an overcoat layer. The overcoat layer comprises a hole transporting hydroxy arylamine compound having at least two hydroxyl functional groups, hydroxy terminated siloxane, and a polyamide film forming binder capable of forming hydrogen bonds with the hydroxyl functional groups of the hydroxy arylamine compound and the hydroxy terminated siloxane.

It would be useful to develop additional photoreceptor overcoats with low surface energy and excellent wear resistance.

SUMMARY

One embodiment is an electrophotographic imaging member comprising a substrate, a charge transport layer, and an overcoat layer formed by combining a film forming binder and a hole transporting hydroxy triarylamine compound having at least one hydroxyl functional group that is linked to a ring carbon of an aryl group by an alkyl group having 1 to 12 carbon atoms and is capable of forming at least one of a physical bond and a chemical bond with the film forming binder. In some cases, the film forming binder comprises a polycarbonate. Often, the triarylamine compound is asymmetrical. Sometimes, the hole transport material comprises an N-(alkylphenyl),N-(alkylphenyl),N-(hydroxyalkylphenyl)amine. In certain cases, the alkyl portions of the alkylphenyl groups each have 1 to 12 carbon atoms. The bond frequently is a hydrogen bond.

In some cases, each alkylphenyl portion of the amine has one or more aliphatic substitutions. The hydroxyalkylphenyl portion of the amine sometimes is linear. In certain cases, at least one alkylphenyl portion of the amine is a methylphenyl group. Typically, the hydroxy triarylamine has no hydroxyl group that is directly linked to an aryl group without an intervening carbon. In some cases, a surface energy reducing silicone material comprising a crosslinkable acrylate monomer is combined with the film forming binder and the hole transporting hydroxy triarylamine.

In some cases, the hole transporting hydroxy triarylamine compound is represented by

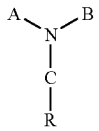

where N is nitrogen, A and B are aryl groups with zero, one or more substitutions, each substitution being selected from the group consisting of C1-C12 carbon chains that are saturated or unsaturated, branched or unbranched, and C3-C12 unsaturated or partially saturated carbon rings, C is an aryl group, and R is a C1 to C12 carbon chain or non-aromatic ring with at least one hydroxyl functional group that is capable of forming at least one of a chemical bond and a physical bond with a film forming binder.

Another embodiment is a method of forming an electrophotographic imaging member comprising providing a substrate coated with a charge transport layer comprising charge transport molecules in a polymer binder, forming over the charge transport layer a coating of a solution comprising (a) a film forming binder, (b) a hole transport material comprising a hydroxy triarylamine compound having at least one hydroxyl functional group that is linked to a ring carbon of an aryl group by an alkyl group having 1 to 12 carbon atoms and is capable of forming a hydrogen bond with the film forming binder, and (c) a solvent. The coating is dried to remove the solvent to form a substantially dry overcoat layer. The film forming binder often is a polycarbonate.

A further embodiment is a coating formed by combining a film forming binder and a hole transporting hydroxy triarylamine compound having at least one hydroxyl functional group that is linked to a ring carbon of an aryl group by an alkyl group having 1 to 12 carbon atoms. At least one of the hydroxyl functional groups is capable of forming at least one of a chemical bond and a physical bond with the film forming binder.

A further embodiment is an electrophotographic imaging member comprising a substrate, a charge transport layer, and an overcoat layer formed by combining a film forming polycarbonate binder, a hole transport material, a surface energy-reducing silicone material comprising a crosslinkable acrylate monomer, and a solvent. The imaging member usually has a critical surface energy of no more than 30 dynes/cm. In some cases, the underlying charge transport layer comprises a polycarbonate. The surface energy-reducing silicone material often crosslinks with itself, and sometimes is UV or heat curable.

Yet another embodiment is a method of forming an electrophotographic imaging member comprising providing a substrate coated with a charge transport layer comprising charge transport molecules in a polymer binder, forming on the charge transport layer a coating of a solution comprising (a) a film forming binder, (b) a hole transport material containing at least one hydroxyl functional group that is capable of forming at least one of a physical bond and a chemical bond with the film forming binder, (c) a surface energy-reducing silicone material comprising a crosslinkable acrylate monomer and (d) a solvent. The surface energy-reducing silicone material is crosslinked and the coating is dried to remove the solvent to form a substantially dry overcoat layer. The imaging member usually has a critical surface energy of no more than 30 dynes/cm. The surface energy-reducing silicone material often is UV or heat curable.

DETAILED DESCRIPTION

In one embodiment, an overcoat including a new hole transport material is disclosed. This overcoat is particularly well-suited for use on an electrophotographic imaging member because it is durable and does not significantly alter the electrical properties of the imaging member. When the overcoat is applied in the form of a solution, no special conditions are required in order to achieve good adhesion and compatibility of the overcoat with the underlying charge transport layer. In another embodiment, an ultra-low surface energy overcoat for an electrophotographic imaging member is provided. The low surface energy results in favorable electrical properties for the imaging member.

As used herein, the term "hole transport material" refers to a material that is capable of transporting positive charges or holes through a layer of an electrophotographic imaging member. "Overcoat" as used herein refers to a protective outer coating layer applied over a charge transport layer of an electrophotographic imaging member. As used herein, the term "alkyl" means a straight or branched-chain alkyl group containing about 1 to about 12, or from about 1 to about 8, or from about 2 to about 6 carbon atoms, such as methyl, ethyl, propyl, isopropyl, butyl, sec-butyl, t-butyl, and pentyl, hexyl and the like. While compounds containing no double bonds are most commonly used, the term "alkyl" as used herein also includes alkenyl compounds containing at least two carbon atoms and at least one double bond, and alkynyl compounds containing at least 2 carbon atoms and at least one triple bond. The alkenyl groups and alkynyl groups contain about 2 to about 12, or from about 2 to about 8, or from about 2 to about 6 carbon atoms. As used herein, "triarylamine" refers to a material having a nitrogen atom with three aromatic groups attached thereto. Each aromatic group can be a phenyl group or a biphenyl group. The phenyl and/or biphenyl groups may be unsubstituted or substituted.

The term "hydroxyl functional group" as used herein generally refers to OH groups, however other groups that function in a manner similar to an OH group, such as an SH group, also can be used. OH groups usually are utilized because of odor issues associated with SH groups. A "hydrogen bond" as used herein is an attractive force or bridge occurring between the polar hydroxyl functional group contained in an arylamine and a film forming binder in which a hydrogen atom of the polar hydroxy arylamine is attracted to the oxygen atom in a binder containing polarizable groups. The hydrogen atom is the positive end of one polar molecule and forms a linkage with the electronegative end of the other polar molecule.

Figure 1:
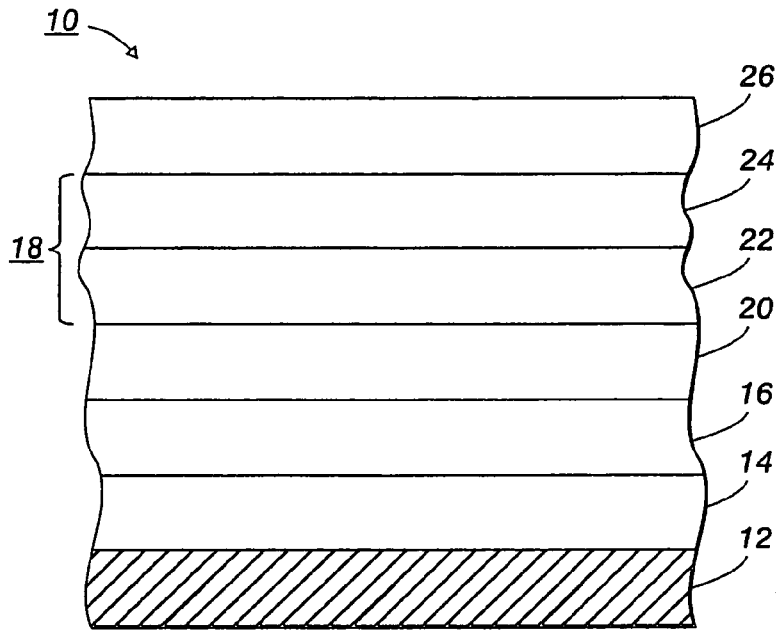
FIG. 1 schematically shows an electrophotographic imaging member according to an embodiment disclosed herein.

Referring to FIG. 1, an electrophotographic imaging member 10 has a flexible or rigid substrate 12 with an electrically conductive surface or coating 14. An optional hole blocking layer 16 may be applied to the surface or coating 14. If used, the hole blocking layer is capable of forming an electronic barrier to holes between an adjacent electrophotographic imaging layer 18 and the underlying surface or coating 14. An optional adhesive layer 20 may be applied to the hole-blocking layer 16.

The one or more electrophotographic imaging layers 18 are formed on the adhesive layer 20, blocking layer 16 or substrate surface or coating 14. Layer 18 may be a single layer that performs both charge generating and charge transport functions, or it may comprise multiple layers such as a charge generating layer 22 and a charge transport layer 24. The charge generating layer 22 can be applied to the electrically conductive surface or coating 14 or can be applied on another surface between the substrate 12 and the charge generating layer 22. Usually the charge generating layer 22 is applied on the blocking layer 16 or the optional adhesive layer 20. The charge transport layer 24 usually is formed on the charge generating layer 22. However, the charge generating layer 22 can be located on top of the charge transport layer 24.

An overcoat 26 is applied over the electrophotographic imaging layer 18 to improve the durability of the electrophotographic imaging member 10. The overcoat 26 is designed to provide wear resistance and image deletion resistance to the imaging member while not adversely affecting the chemical and/or physical properties of the underlying layers during the coating process and not adversely affecting the electrical properties of the resulting imaging member. Selection of appropriate components for the overcoat 26 is important in order to achieve these diverse requirements.

The substrate 12 of the imaging member may be flexible or rigid and may comprise any suitable organic or inorganic material having the requisite mechanical and electrical properties. It may be formulated entirely of an electrically conductive material, or it can be an insulating material including inorganic or organic polymeric materials, such as polyester, polyester coated titanium, a layer of an organic or inorganic material having a semiconductive surface layer, such as indium tin oxide, aluminum, aluminum alloys, titanium, titanium alloys, or any electrically conductive or insulating substance other the aluminum, or may be made up of exclusively conductive materials, such as aluminum, semitransparent aluminum, chromium nickel, brass, copper, nickel, chromium, stainless steel, cadmium, silver, gold, zirconium, niobium tantalum, vanadium hafnium, titanium, tungsten, indium, tin, metal oxides, conductive plastics and rubbers, and the like. In embodiments where the substrate layer is not conductive, the surface is rendered electrically conductive by an electrically conductive coating. The coating typically but not necessarily has a thickness of about 20 to about 750 angstroms.

The optional hole blocking layer 16 comprises any suitable organic or inorganic material having the requisite mechanical and electrical properties. The hole blocking layer 16 can be comprised of, for example, polymers such as polyvinylbutyral, epoxy resins, polyesters, polysiloxanes, polyamides, polyurethanes, and the like, or may be nitrogen containing siloxanes or nitrogen containing titanium compounds such as trimethoxysilyl propylene diamine, hydrolyzed trimethoxysilyl propyl ethylene diamine, N-beta-(aminoethyl)gamma-amino-propyl trimethoxy silane, isopropyl 4-aminobenzene sulfonyl, di(dodecylbenzene sulfonyl)titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-aminobenzene sulfonate oxyacetate, titanium 4-aminobenzoate isostearate oxyacetate, $[H_2N(CH_2)_4]CH_3Si(OCH_3)_2$, gamma-aminobutyl)methyl diethoxysilane, $[H_2N(CH_2)_3]CH_3Si(OCH_3)_2$, (gamma-aminopropyl)-methyl diethoxysilane, vinyl hydroxyl ester and vinyl hydroxy amide polymers wherein the hydroxyl groups have been partially modified to benzoate and acetate esters that modified polymers are then blended with other unmodified vinyl hydroxy ester and amide unmodified polymers, alkyl acrylamidoglycolate alkyl ether containing polymer, the copolymer poly(methyl acrylamidoglycolate methyl ether-co-2-hydroxyethyl methacrylate), zinc oxide, titanium oxide, silica, polyvinyl butyral, and phenolic resins. The blocking layer often is continuous and usually has a thickness of less than from about 10 micrometers, and more specifically, from about 1 to about 5 micrometers.

The optional adhesive layer 20 can comprise, for example, polyesters, polyarylates, polyurethanes, copolyester-polycarbonate resin, and the like. The adhesive layer may be of a thickness, for example, from about 0.01 micrometers to about 2 micrometers after drying, and in other embodiments from about 0.03 micrometers to about 1 micrometer.

The charge generating layer 22 contains a charge generating material. Numerous charge generating materials for transporting holes into the charge transport layer are known, including inorganic pigments such as zinc oxide and cadmuim sulfide, and organic pigments such as phthalocyanine type pigment (metal containing—such as copper, indium, gallium, tin, titanium, zinc, vanadium, silicon or germanium, oxides or halides of the above-listed materials, and non-metal containing—such as X-type or τ-type phthalocyanine, chloroindium phthalocyanine, chlorogallium phthalocyanine, hydroxygallium phthalocyanine, hydroxysilicon phthalocyanine, oxytitanium phthalocyanine), a polycyclic quinone type pigment, a perylene pigment (such as benzimidazole perylene), an azo type pigment and a quinacridone type pigment. Charge generating materials may be bound by various binder resins such as polyester resin, polyvinyl acetate, polyacrylate, a polymethacrylate, a polyester, a polycarbonate, a polyvinyl acetoacetal, a polyvinyl propional, a polyvinyl butyral, a phenoxy resin, an epoxy resin, an urethane resin, a cellulose ester and a cellulose ether.

When the photogenerating material is present in a binder material, the photogenerating composition or pigment may be present in the film forming polymer binder compositions in any suitable or desired amounts. The particle size of the photoconductive compositions and/or pigments may be less than the thickness of the deposited solidified layer or, for example, between about 0.01 micron and about 0.5 micron to facilitate better coating uniformity.

The charge generating layer 22 containing photoconductive compositions and the resinous binder material may range in thickness, for example, from about 0.05 micron to about 10 microns or more, alternatively from about 0.1 micron to about 5 microns, or alternatively from about 0.3 micron to about 3 microns, although the thickness can be outside these ranges. The thickness is related to the relative amounts of photogenerating compound and binder, with the photogenerating material, for example, being present in amounts of from about 5 to about 100 percent by weight. Higher binder content compositions generally require thicker layers for charge generation.

The charge generating layer 22 can be applied to underlying layers by any desired or suitable method. Any suitable technique may be utilized to mix and thereafter apply the charge generating layer coating mixture. Application techniques include spraying, dip coating, roll coating, wire wound rod coating, and the like. Drying of the deposited coating may be effected by any suitable technique, such as oven drying, infra red radiation drying, air drying and the like.

A suitable solvent may be utilized to dissolve the film forming binder in the charge generating layer 22. Typical solvents include, for example, tetrahydrofuran, toluene, methylene chloride, monochlorobenzene and the like. Coating dispersions for charge generating layer may be formed by any suitable technique using, for example, attritors, ball mills, Dynomills, paint shakers, homogenizers, microfluidizers, and the like.

The charge transport layer 24 may comprise one or more layers or regions, such as a bottom charge transport layer and an upper or additional charge transport layer(s) such as disclosed in U.S. Pat. No. 7,005,222, assigned to Xerox Corporation, which is herein incorporated by reference in its entirety. The charge transport layer may have a thickness of between, for example, from about 10 micrometers to about 50 micrometers. The thickness of the charge transport layer to the charge generating layer may be maintained from about 2:1 to about 200:1; and in some instances as great as about 400:1.

The active charge transport layer may comprise any suitable activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the direction of photogenerated holes from the generation material and capable of allowing the transport of these holes through the active layer in order to discharge the surface charge on the active layer.

Further details of the structure and composition of the layers of an imaging member can be found in commonly assigned U.S. Pat. Nos. 6,790,573, 6,835,515, 7,026,083, 6,780,554 and U.S. Patent Publication No. 2006/0110669 A1, the contents of which are incorporated herein by reference in their entirety.

In one embodiment, the overcoat 26 for the imaging member is formed by combining a film forming binder with a hole transporting hydroxy triarylamine compound having at least one hydroxyl functional group that is linked to a ring carbon of an aryl group by an alkyl group having 1 to 12 carbon atoms and is capable of forming a physical and/or chemical bond with the film forming binder. The hydroxyalkylphenyl portion of the amine usually is aliphatic and the hole transport material usually is asymmetrical. Use of this hole transport material results in a durable coating that is resistant to crystallization and cracking when subjected to heat and extended wear. While not intending to be bound by theory, the combination of the strong affinity of the hydroxyl functional group with the polymer binder, along with the asymmetry of the hole transport material, may prevent the crystallization of the hole transport material under physical stress and thermal processing. The alkyl substitutions on the aryl groups may help to prevent oxidation by oxidative gases.

One type of hole transport material that is useful in the overcoat is shown below:

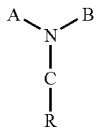

In this structure, N is nitrogen. A and B are aryl groups with zero, one or more substitutions, each of which is selected from the group consisting of C1-C12 carbon chains that are saturated or unsaturated, branched or unbranched, and can include a hydroxyl functional group, and C3-C12 unsaturated or partially saturated carbon rings which may include a hydroxyl functional group. C is an aryl group. R is a C1 to C12 carbon chain or non-aromatic ring with at least one hydroxyl functional group that is capable of forming at least one of a chemical bond and a physical bond with a film forming binder. R usually is selected from the group consisting of hydroxy substituted C1-C12 carbon chains that are saturated or unsaturated, branched or unbranched, and hydroxy substituted C3-C12 unsaturated or partially saturated carbon rings. This material usually has a molecular weight in the range of 200-2000. The carbon chains often are C1 to C8 or C3 to C5 chains. The carbon rings often are C3 to C8 or C3 to C5 rings. The dried overcoat layer often has a thickness of 0.05 to 10 microns, or 0.1 to 5 microns. However, thinner or thicker overcoats can be used as long as the desired physical and electrical properties are obtained.

Non-limiting examples of hole transport materials represented by the structural formula shown above include N-(4-methylphenyl),N-(3,4-dimethylphenyl),N-(4-(3-hydroxypropyl)phenyl)amine, N-(3-ethylphenyl), N-(3-methyl-4-ethylphenyl),N-(4-(3-hydroxypropyl)phenyl)amine; N,N-diphenyl,N-(3-(2-hydroxyethyl)phenyl)amine; N,N-di(3,4-dimethylphenyl),N-(4-(3-hydroxypropyl)phenyl)amine; N-(4-cyclohexylphenyl),N-(3-methyl-4-ethylphenyl),N-(4-(3-hydroxypropyl)phenyl)amine; N-(4-methylphenyl),N-(3-isopropyl-4-methylphenyl),N-(4-(3-hydroxypropyl)phenyl) amine; and N-(3-methylphenyl), N-(3-methyl-4-cyclohexylphenyl),N-(4-(3-hydroxypropyl)phenyl)amine.

Non-limiting examples of suitable binders for the photoconductive materials include thermoplastic and thermosetting resins such as polycarbonates, polyesters, including polyethylene terephthalate, polyurethanes, polystyrenes, polybutadienes, polysulfones, polyarylethers, polyarylsulfones, polyethersulfones, polycarbonates, polyethylenes, polypropylenes, polymethylpentenes, polyphenylene sulfides, polyvinyl acetates, polyvinylbutyrals, polysiloxanes, polyacrylates, polyvinyl acetyls, polyamides, polyimides, amino resins, phenylene oxide resins, terephthalic acid resins, phenoxy resins, epoxy resins, phenolic resins, polystyrene and acrylonitrile copolymers, polyvinylchlorides, polyvinyl alcohols, poly-N-vinylpyrrolidinone)s, vinylchloride and vinyl acetate copolymers, acrylate copolymers, alkyd resins, cellulosic film formers, poly(amideimide), styrene-butadiene copolymers, vinylidenechloride-vinylchloride copolymers, vinylacetate-vinylidenechloride copolymers, styrene-alkyd resins, polyvinylcarbazoles, and the like. These polymers may be block, random or alternating copolymers. The charge transport particles usually are dissolved or molecularly dispersed in the binder. In one embodiment, tetra(ethylene glycol) methacrylate and methacrylate ended silicone fluid are used as binders. Methacrylate groups quickly undergo free-radical polymerization upon heating.

The binder for the overcoat often comprises a polycarbonate. Examples of electrically inactive binders include polycarbonate resins with a weight average molecular weight of from about 20,000 to about 100,000. In certain embodiments, a weight average molecular weight of from about 50,000 to about 100,000 is specifically selected. Excellent imaging results are achieved with poly(4,4'-diphenyl-1,1'-cyclohexane carbonate) polycarbonate; poly(4,4'-diphenyl-1,1'-cyclohexane carbonate-500), with a weight average molecular weight of 51,000; or poly(4,4'-diphenyl-1,1'-cyclohexane carbonate-400), with a weight average molecular weight of 40,000.

Other binders that provide for good bonding with the hydroxyl groups of the hole transport material combined with good filming form capability and a glass transition temperature usually higher than 0° C. also can be used.

A solvent that will dissolve the hole transport material and the binder is also employed. Non-limiting examples of suitable solvents include tetrahydrofuran, toluene, methyl ethyl ketone, methanol, ethyl alcohol, methylene chloride, tetrachloroethane, actone, xylene, benzene, chlorobenzene, propanol, and water.

While not intending to be bound by theory, it is believed that the overcoat used in the embodiments disclosed herein is physically mixed with the underlying substrate but has little if any chemical bonding with the underlying substrate.

In some embodiments, a crosslinkable silicon-containing material is added to the overcoat composition to provide ultra-low surface energy to the imaging member. Non-limiting examples of such materials include methacryloxy terminated silicone fluid GP-537, GP-478 and GP-446 from Genesee Polymers Corporation. A particularly useful crosslinkable silicone is supplied by California Hardcoatings Co. under the name Dura-New-V-5. While the composition of this material is not publicly available, the technical bulletin and MSDS sheets for this material indicate that it is a UV curable or heat curable acrylate resin in a 2-butanol solvent, with a boiling point of 98 Deg. C., a specific gravity of greater than 0.8 and a vapor density greater than 1 (where the vapor density of air=1). The silicone material is soluble in the selected solvent to make it suitable for coating before it is cured. The silicone material reduces the surface energy by 1-99% or by 10-80% or by 20-60% as compared to an overcoat that does not contain such a material.

Sometimes, the silicone material has one or more reactive groups such as isocyanate, acrylate, vinyl, epoxy, silanol, carboxylic acid, aldehyde, or hydroxyl groups that provide strong interactions with other materials for adhesion purposes. While a significant portion of the silicone material is made up of carbon-silicon compounds which provide low surface energy and self-assembling capability, in certain cases the surface energy-reducing silicone material includes silica particles and/or fluorocarbon compounds.

The following examples show certain embodiments and are intended to be illustrative only. The materials, conditions, process parameters and the like recited herein are not intended to be limiting.

EXAMPLE 1

N-(4-methylphenyl), N-(3,4-dimethylphenyl),N-(4-(3-hydroxypropyl)phenyl)amine (HO-TPA) was synthesized using the following procedure: 21.8 g of 4-iodotoluene, 28.3 g of methyl (3-(4-(3,4-dimethylphenyl)amino)phenyl)propionate, 27.6 g of potassium carbonate and 6.0 g of copper(II) sulfate were mixed and stirred under argon gas protection. This mixture was heated at 230° C. for 16 hours. When the mixture was cooled to about 110° C., 200 ml of toluene was added, and the slurry was stirred at this temperature for 2 hours. The solid in the slurry was then filtered off. To the filtrate, 100 ml of methanol and 10 ml of concentrated sulfuric acid were added, and the solution was heated to boiling for 24 hours. After purification using a mixture of toluene and methanol, a slightly brown solid was obtained. This solid was then hydrogenated using sodium borohydride in tetrahydrofuran, resulting in HO-TPA crystals. The HO-TPA crystals had a molecular weight of 345.49, an exact mass of 345, and a molecular formula $C_{24}H_{27}NO$.

EXAMPLE 2

An overcoat solution containing the N-(4-methylphenyl), N-(3,4-dimethylphenyl),N-(4-(3-hydroxypropyl)phenyl) amine (HO-TPA) synthesized in Example 1 was prepared as follows. Thirty-nine grams of polycarbonate (PCZ-500, (Lupilon®500, Mitsubishi Gas Chemical Corp.)) was dissolved in 800 g of tetrahydrofuran solvent to form a clear solution. The HO-TPA from Example 1 was added in an amount of 52 g and the resulting solution was stirred for 30 minutes. Next, 8 g of tetra(ethylene glycol) dimethacrylate (Sigma-Aldrich), 0.5 g of methacrylate ended silicone fluid (Genesee Polymers Corporation) and 0.5 g of free radical initiator axobisisobutylonitrile (AIBN) (Sigma-Aldrich) were added. The mixture was stirred for one hour at room temperature.

The overcoat solution was applied on a Xerox iGen-3 photoreceptor device that did not have the usual overcoat using a 0.5-mil Bird bar and dried at 120 Deg. C. for three minutes. The dried overcoat had a thickness of 1.0 microns.

For comparison, a Xerox iGen-3 photoreceptor device (Xerox Corp.) without the usual overcoat was used as Comparative Example 2. Electrical properties of the embodiments of Example 2 and Comparative Example 2 were tested on an AMAT 4000 scanner and are shown below on Table 1.

TABLE 1

| Electrical Data | | |
|---|---|---|
| Sample | Comparative Example 2 | Example 2 |
| $V_0$ | 499.60 | 500.00 |
| S | 370.86 | 397.92 |
| $V_c$ | 122.58 | 133.17 |
| $V_r$ | 37.66 | 59.82 |

TABLE 1-continued

| Electrical Data | | |
|---|---|---|
| Sample | Comparative Example 2 | Example 2 |
| $V_{dd}$ | 39.97 | 39.44 |
| $V_{depl}$ | 14.66 | 32.53 |
| $V_{cyc\text{-}up\ (10k)}$ | 16.32 | 17.69 |

$V_0$ is the initial potential after charging
S is the initial slope of the photoinduced discharge curve (PIDC), which is a measurement of sensitivity
$V_c$ is the surface potential at which the PIDC slope is S/2
$V_r$ is the residual voltage
$V_{dd}$ is 0.2 s duration dark decay voltage
$V_{depl}$ is the difference between applied voltage and $V_0$
$V_{cyc\text{-}up}$ is the residual charge after a 10,000 cycling test Example 2 had higher sensitivity than Comparative Example 2 and stable cycling performance. Although the embodiment of Example 2 had slightly higher $V_r$ and $V_{depl}$ than Comparative Example 2, the electrical properties of the embodiment of Example 2 were acceptable.

Thermal Stability—Example 2 and Comparative Example 2 were heated at 145 Deg. C. for 30 minutes to test thermal stability. The embodiment of Comparative Example 2 had numerous crystallization cracks when examined under a microscope. The embodiment of Example 2 had no cracks.

The surface energies of the photoreceptors of Example 2 and Comparative Example 2 were determined through contact angle measurements. The results are shown on Table 2. The embodiment of Example 2 had significantly lower surface energy than that of Comparative Example 2.

TABLE 2

| Surface Energy | | | | | | | | |
|---|---|---|---|---|---|---|---|---|
| | <CA> | <CA> | <CA> Ethylene | Owen, Wendt, Rabel & Kaeble (OWRK) method | | | Equation of State | Zisman critical |
| Sample #, treatment | Water deg. | Glycerol, deg. | glycol deg. | SE dyne/cm | $SE_{disp}$ dyne/cm | $SE_{polar}$ dyne/cm | SE dyne/cm | SE, dyne/cm |
| Comp. Ex. 2 | 99.5 | 78.0 | 71.2 | 29.4 | 28.7 | 0.7 | 26.3 | 15.3 |
| Std. Dev. | 3.9 | 4.1 | 6.0 | 9.7 | 9.5 | 1.7 | 2.3 | 3.8 |
| Example 2 | 100.8 | 96.7 | 79.0 | 15.9 | 12.7 | 3.1 | 21.0 | 2.7 |
| Std. Dev. | 2.2 | 4.3 | 4.1 | 5.0 | 4.5 | 2.2 | 0.8 | 3.8 |

The large variation in CA measurements may be due to sample surface contamination in electrical tests.

Scratch resistance measurements were made for the samples of Example 2 and Comparative Example 2 using a 17 micron conical diamond stylus penetrating the coating at increasing load to about 200 nm in depth. Details of the Scratch Test and Indentation Test are provided below. These scratches were not visible in a microscope. As shown on Table 3, the friction coefficient and maximum friction force were lower for Example 2 than for Comparative Example 2. Hardness was measured with a sharp cube corner tip diamond stylus. Initially the scratch resistance was also measured using the sharper tip but the damage to the photoreceptor surface overshadowed any material differences between the samples.

In the Scratch Test, ten scratches were made on each sample using a conical diamond stylus with a tip radius of 17 microns. The friction coefficient was calculated by dividing the measured lateral force by the normal load. The maximum depth of the scratches ranged from 150 nm to 200 nm. In the Indentation Test, nine indentations, 10 microns apart, were placed on the surface of each sample to a load of 100 at a loading rate of 20 μN/s. The hardness H was determined from the maximum load divided by the contact area, H=Pmax/Ac. The reduced modulus $E_{red}$ was calculated by equation (1) using the Oliver Pharr method by determining the contact area Ac from the area function of the Berkovich tip, equation (2) and calculating the unloading slope dP/dh. E is the elastic modulus of the sample and v is the Poisson's ratio. The tip area function Ac of the Berkovich tip was determined from indentation on aluminum plate as standard procedure.

$$E_{red.} = \frac{E}{1-\nu^2} = \frac{\sqrt{\pi}}{2}\frac{dP}{dh}\frac{1}{\sqrt{A_C}} \quad (1)$$

$$A_C\ (\mathrm{nm}^2) = 4.9281h_C^2 + 1.4634e2h_C \quad (2)$$

TABLE 3

Surface mechanical properties of coatings

| Sample | friction coefficient | stdev | Max. friction force (μNewton) | stdev | Modulus (GPa) | stdev | Hardness (GPa) | stdev |
|---|---|---|---|---|---|---|---|---|
| Comp. Ex. 2 (no overcoat) | 0.30 | 0.01 | 274.68 | 24.56 | 8.18 | 0.46 | 0.70 | 0.05 |
| Ex. 2 (with overcoat) | 0.12 | 0.01 | 99.17 | 6.77 | 6.82 | 0.47 | 0.48 | 0.06 |

EXAMPLE 3

Figure 2:
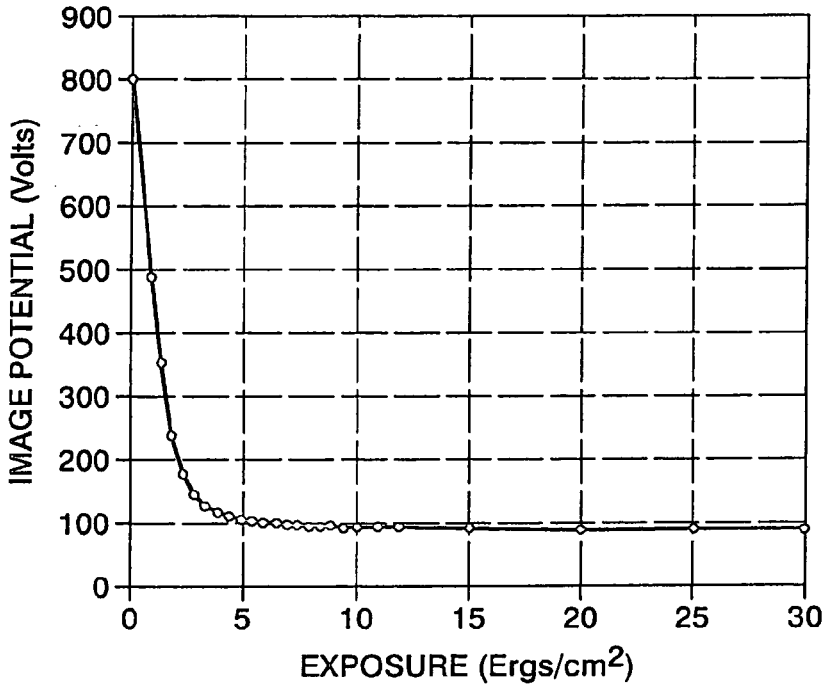
FIG. 2 is an image potential curve for an electrophotographic imaging member having an overcoat containing a particular hydroxy triarylamine.

A combination of three different hole transport materials, namely 0.4 g of N,N'-bis(4-methylphenyl)-N,N'-bis(4-ethylphenyl)-[1,1'-(3,3'-dimethyl)biphenyl]-4,4'-diamine (Ab-16 from Xerox), 0.4 g of tri-4-tolylamine (TTA) (Xerox Corp.) and 0.4 g of 1,1-bis(di-4-tolylaminophenyl)cyclohexane (Xerox Corp.) were placed in a brown bottle, along with 1.2 g of polycarbonate PCZ-500 (Mitsubishi Chemicals), a small pinch of free radical initiator, 2,2'-Azobisisobutyronitrile, 0.3 g of Dura-New-V-5 silicone resin (California Hardcoatings Co, Chula Vista, Calif.) and 37.3 g of tetrahydrofuran (THF) solvent. The bottle was set in a rolling mill to mix the materials for three hours. The mixed solution was then coated on a Xerox Tigris photoreceptor device) that did not have the usual overcoat using a 0.5 mil Bird bar. The coated device was dried at 120 Deg. C. for 15 minutes. The dried overcoat had a thickness of about 1.0 microns. Electrical properties of the photoreceptor of Example 3 were tested in an AMAT 4000 scanner at a relative humidity of 40% and a temperature of 21.1 Deg. C. The photoinduced discharge curve is obtained by electrically testing the devices with a cyclic scanner. The light intensity is incrementally increased with cycling to produce a photoinduced discharge curve from which the photosensitivity is measured. The results are shown below on Table 4. The image potential was measured and the results are shown on FIG. 2.

TABLE 4

Photoinduced Discharge Curve Data

| Sample | Example 3 |
|---|---|
| $V_0$ | 798.81 |
| S | 333.07 |
| $V_c$ | 148.51 |
| $V_r$ | 87.38 |
| $V_{dd}$ | 19.62 |

TABLE 4-continued

Photoinduced Discharge Curve Data

| Sample | Example 3 |
|---|---|
| $V_{depl}$ | 45.05 |
| $V_{cyc\text{-}up\ (10k)}$ | 50.66 |

The surface energies of the photoreceptor of Example 3 and a control, a Xerox Tigris photoreceptor with no overcoat included, designated as Comparative Example 3, were determined using contact angle measurements. The contact angles of three solvents, namely water, glycerol and ethylene glycol were measured at room temperature. Critical surface energies of these samples were obtained through a Zisman plot. The results are shown below on Table 5.

TABLE 5

Surface Energy

| | | |
|---|---|---|
| Comp. Ex. 3 | Surface Energy (Critical), dynes/cm | 41.20 |
| Example 3 | Surface Energy (Critical), dynes/cm | 27.24 |

Thus, the overcoat reduced the surface energy of the photoreceptor by about 33%.

It will be appreciated that various of the above-disclosed and other features and functions, or alternative thereof, may be desirably combined into many other different systems or application. Various presently unforeseen or unanticipated alternatives, modifications, variations, or improvements therein may be subsequently made by those skilled in the art which are also intended to be encompassed by the following claims.

What is claimed is:

1. An electrophotographic imaging member comprising a substrate, a charge generating layer, a charge transport layer, and an overcoat layer formed by combining a film forming binder comprising a polycarbonate and a hole transporting hydroxy triarylamine compound having at least one hydroxyl functional group that is linked to a ring carbon of an aryl group by an alkyl group and forms at least one of a chemical bond and a physical bond with the film forming binder, the hole transporting hydroxy triarylamine compound comprising N-(alkylphenyl),N-(alkylphenyl),N-(hydroxyalkylphenyl)amine, the alkyl portions of the alkylphenyl groups each having 1 to 12 carbon atoms.

2. The imaging member of claim 1, wherein the hole transporting hydroxy triarylamine compound is asymmetrical.

3. The imaging member of claim 1, wherein the hydroxyl functional group forms a hydrogen bond with the film forming binder.

4. The imaging member of claim 1, wherein the hydroxyalkylphenyl portion of the amine is linear.

5. The imaging member of claim 1, wherein at least one alkylphenyl portion of the amine is a methylphenyl group.

6. The imaging member of claim 1, wherein the hole transporting hydroxy triarylamine compound has no hydroxyl functional groups directly linked to an aryl group.

7. The imaging member of claim 1, wherein the hole transporting hydroxy triarylamine compound has a molecular weight in the range of 200-2000.

8. The imaging member of claim 1, wherein the hole transporting hydroxy triarylamine compound comprises N-(4-methylphenyl),N-(3,4-dimethylphenyl),N-(4-(3-hydroxypropyl)phenyl)amine.

9. The imaging member of claim 1, wherein a surface energy-reducing silicone material comprising a crosslinkable acrylate monomer is combined with the film forming binder and the hole transporting hydroxy triarylamine.

10. A method of forming an electrophotographic imaging member comprising providing a substrate coated with a charge generating layer and a charge transport layer comprising charge transport molecules in a polymer binder, forming over the charge transport layer a coating of a solution comprising (a) a film forming binder comprising a polycarbonate, (b) a hole transport material comprising a hydroxy triarylamine compound having at least one hydroxyl functional group that is linked to a ring carbon of an aryl group by an alkyl group and forms at least one of a chemical bond and a physical bond with the film forming binder, the hole transporting hydroxy triarylamine compound comprising N-(alkylphenyl),N-(alkylphenyl),N-(hydroxyalkylphenyl)amine, the alkyl portions of the alkylphenyl groups each having 1 to 12 carbon atoms, and (c) a solvent, and drying the coating to remove the solvent to form a substantially dry overcoat layer.

11. The method of claim 10, wherein the hole transport material comprises N-(4-methylphenyl),N-(3,4-di-methylphenyl),N-(4-(3-hydroxypropyl) phenyl)amine.

12. A coating formed by combining a film forming binder comprising a polycarbonate and a hole transporting hydroxy triarylamine compound having at least one hydroxyl functional group that is linked to a ring carbon of an aryl group by an alkyl group and forms at least one of a chemical bond and a physical bond with the film forming binder, the hole transporting hydroxy triarylamine compound comprising N-(alkylphenyl),N-(alkylphenyl),N-(hydroxyalkylphenyl)amine, the alkyl portions of the alkylphenyl groups each having 1 to 12 carbon atoms.

* * * * *